US006943735B1

(12) United States Patent
Cadotte, Jr.

(10) Patent No.: US 6,943,735 B1
(45) Date of Patent: Sep. 13, 2005

(54) ANTENNA WITH LAYERED GROUND PLANE

(75) Inventor: Roland Cadotte, Jr., Freehold, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 2 days.

(21) Appl. No.: 10/783,082

(22) Filed: Feb. 20, 2004

(51) Int. Cl.[7] ..... H01Q 1/38
(52) U.S. Cl. ..... 343/700 MS; 343/846
(58) Field of Search ..... 343/700 MS, 846, 343/786; 29/601

(56) References Cited

U.S. PATENT DOCUMENTS

| | | | | |
|---|---|---|---|---|
| 5,359,339 A | | 10/1994 | Agrawal et al. | 343/786 |
| 5,459,474 A | | 10/1995 | Mattioli et al. | 343/702 |
| 5,739,796 A | * | 4/1998 | Jasper et al. | 343/895 |
| 5,898,409 A | | 4/1999 | Holzman | 343/786 |
| 6,031,188 A | | 2/2000 | Pluymers et al. | 174/255 |
| 6,081,988 A | | 7/2000 | Pluymers et al. | 29/601 |
| 6,081,989 A | | 7/2000 | Pluymers et al. | 29/601 |
| 6,188,361 B1 | * | 2/2001 | George et al. | 343/700 MS |
| 6,316,719 B1 | | 11/2001 | Pluymers et al. | 174/28 |
| 6,590,478 B2 | | 7/2003 | Pluymers | 333/246 |

* cited by examiner

*Primary Examiner*—Tan Ho
(74) *Attorney, Agent, or Firm*—Duane Morris LLP

(57) ABSTRACT

An antenna structure for solid-state fabrication includes a ground plane comprising a stack of a plurality of planar conductors, each having its broad surfaces adjacent to, but insulated from, adjacent planar conductors. At least one edge of each conductor of the stack is registered with like edges of other conductors to define a discontinuous surface. A radiating element is spaced from the surface. Through vias extend between the conductors of the stack to form a conductive matrix. A feed for the radiating element extends toward, but does not contact, the matrix.

22 Claims, 10 Drawing Sheets

ANTENNA WITH LAYERED GROUND PLANE

FIELD OF THE INVENTION

This invention relates to antennas, and more particularly to solid-state antennas.

BACKGROUND OF THE INVENTION

An antenna transduces electromagnetic waves between a guided mode and unguided radiation. The use of antennas for transmission and reception of such radiation antedates a full understanding of the properties of antennas. Consequently, many of the terms used in the antenna arts have meanings which, while well understood in those arts, may be confusing to the less skilled. For example, the term "antenna beam" is ordinarily understood to refer to the unguided radiation emitted from an antenna when guided waves are applied to its "feed" point or port. However, the term also applies to the response of an antenna to received unguided radiation as manifested by guided electromagnetic waves at the "feed" in the presence of plane wave unguided radiation, and the characteristics of the antenna beam in a reception mode are identical to the characteristics of the beam in a transmission mode. The "feed" port may receive guided radiation from an external source when the antenna is operated in a transmitting mode, and may also generate or produce guided waves when the antenna receives unguided radiation. Thus, the transmission and reception of electromagnetic signals are conceptually linked, and the term "transmission/reception" can be applied to the antenna function.

An antenna "beam" may be characterized in a simplistic manner by specifying the solid or subtended angle, as seen from the antenna, in which the beam resides. The subtended angle is determined at a given relative power level, such as −3 dB, relative to the peak power level of the beam. The measurement of directivity of an antenna is made by comparing the "strength" of the radiation at the (or a) peak of the beam with the strength which the radiation would have if it were uniformly distributed over a sphere (over all solid angles). Antenna directivity is a theoretical construct, which is often used interchangeably with antenna "gain." The gain of an antenna is a combination of the directivity together with the heating or dissipative (and possibly other) losses associated with the antenna, and thus is something which can be measured. The determination of gain is generally made by comparing the measured energy at beam peak with the beam-peak energy of a standard antenna, such as a monopole, dipole, or simple horn. Explanations of antenna operation may be couched in terms of either transmission or reception, depending on which is easier to understand. However, it should be understood that an equivalent explanation applies to operation in the other mode.

Many modern antennas for electromagnetic communication or surveillance uses require substantial or "high" directivity, or the ability to form a radiated beam which subtends a relatively small angle. This is associated with high gain. High gain is desirable in order to place maximum electromagnetic signal energy at the reception point, or equivalently for extracting the maximum amount of guided wave energy from a received unguided wave. The attaining of high directivity or high gain is ordinarily associated with a large "radiating aperture," which relates to the physical dimensions of the antenna in a plane generally orthogonal to the direction of electromagnetic wave propagation or radiation.

In the past, "reflector" antennas have been used to attain relatively large apertures. Everyone has seen at least pictures of terrestrial "dish" antennas used for space communications. Such antennas attain a large radiating aperture by intercepting unguided waves over a relatively large area, and "focussing" the radiation to a smaller area, where the antenna proper (as distinguished from the reflector) is located. The antenna proper, located at the focus of the reflector, has more electromagnetic energy available to transduce into guided-wave form for use by a receiving apparatus than it would have without the reflector.

Modern communication or radar systems achieve many advantages, including inertia-free scanning, by the use of an array antenna occupying the radiating aperture. An array antenna often includes at least a line array, and often a two-dimensional array, of antenna elements, which are "fed" from a common source by means of adjustable phase shifters, and possibly adjustable attenuators, to enable the antenna beam to be moved or directed in space without the need to physically move the antenna itself. In many situations, the antenna array is a two-dimensional array of elemental antennas, each of which elemental antennas is fed (in either the transmission or reception mode) with electromagnetic signals having phase and or amplitude which differ from one antenna element to the next (or from one group of antenna elements to the next). The structure which provides the desired phase shifts and or amplitude adjustment is known as a "beamformer."

The manufacture of array antennas is well known in the art. In the design of array antennas, the spacing of the elemental antennas is often selected in conjunction with the desired operating wavelength to mitigate certain unwanted "grating" antenna lobes. In general, the spacing between adjacent elemental antennas in an array is maintained at one-half wavelength or less, although some antennas take advantage of the grating lobes in producing their desired beam shapes.

Among the problems associated with the manufacture of array antennas is the need to associate with each elemental antenna (or group of elemental antennas) a beam control element, such as a phase shifter, an attenuator, or both. At the frequencies at which many array antennas operate, signal transmission path lengths must be minimized, in order to avoid unwanted losses in the transmission paths. Consequently, the control elements must be kept close to the associated antenna elements. A common arrangement is to physically place the control element immediately behind its associated elemental antenna, where the radiation side of the radiating aperture is the corresponding "front." Such an arrangement is described in U.S. Pat. No. 5,459,474, issued Oct. 17, 1995 in the name of Mattioli et al. The Mattioli et al. arrangement includes an array of horn-like elemental antennas fabricated in a conductive plate, with a slide-in carrier which mates with the elemental antennas. The resulting structure is complex and expensive. A short-horn antenna suitable for such use is described in U.S. Pat. No. 5,359,339, issued Oct. 25, 1994 in the name of Agrawal et al.

Other patents describe various prior approaches to making mating connections between antenna elements and a beamformer. U.S. Pat. No. 5,898,409, issued Apr. 27, 1999 in the name of Holzman describes an elemental antenna adapted for use in an antenna array. U.S. Pat. Nos. 6,081,988 and 6,081,099, both issued Jul. 4, 2000 in the name of Pluymers et al., describe interconnection of a planar circuit to other circuits, such as beamformers, by way of compliant fuzz buttons in a coaxial transmission-line structure. U.S. Pat.

No. 6,316,719, issued Nov. 18, 2001, and U.S. Pat. No. 6,031,188, issued Feb. 29, 2000, both in the name of Pluymers et al. describe the use of compliant "fuzz buttons" in a transmission line for use in coupling together planar circuits. U.S. Pat. No. 6,590,478, issued Jul. 8, 2003 in the name of Pluymers describes a coaxial connector made from spring material for providing electromagnetic coupling between mutually parallel printed-circuit boards. U.S. Pat. No. 6,465,730, issued Oct. 15, 2002 in the name of Pluymers et al. describes fabrication of a circuit module with a coaxial transmission line for facilitating connections of a module to a "radio frequency" (RF) manifold, such as a beamformer. Many of the techniques described in these patents require substantial labor for making the large numbers of interconnections between the beamformer or control structure and the array of antenna elements.

Improved or alternative arrangements or methods are desired for array antennas.

SUMMARY OF THE INVENTION

An antenna according to an aspect of the invention comprises a plurality or set of planar conductors, each of which planar conductors defines a broad side and an edge. The plurality of planar conductors is placed in an array with the broad side of each planar conductor parallel with the broad side of other planar conductors of the plurality, and with the edges of the plurality of planar conductors in registry with corresponding edges of others of the plurality. The registered edges of the planar conductors define a discontinuous surface. A set or plurality of plated-through vias interconnects the plurality of mutually parallel planar conductors to thereby define a matrix of conductors or ground. An electromagnetic radiating element for transmitting/receiving electromagnetic waves is located adjacent the surface but spaced therefrom, and oriented with an electrical conductor lying parallel with the surface.

In an advantageous embodiment of this aspect of the invention, the electromagnetic radiating element defines a feed point, and the antenna further comprises an electrical conductor connected to the feed point. The electrical conductor extends perpendicular to the surface and at least into a plane defined by the matrix of conductors, electrically isolated from the matrix of conductors.

In another advantageous embodiment of this aspect of the invention, the electromagnetic radiating element for transmitting/receiving electromagnetic waves comprises an electrically conductive material lying in a plane parallel to the surface. The electrically conductive material is electrically isolated from the matrix of conductors. The electrically conductive material defines an electrically nonconductive region, the dimensions of which region are selected for transmitting/receiving over a predetermined electromagnetic frequency range. In this other advantageous embodiment, the antenna further comprises an aperture-exciting electrically conductive element lying between the electrically nonconductive region and the matrix of conductors. A feed conductor is in contact with the aperture-exciting electrically conductive element and extends from the aperture-exciting electrically conductive element perpendicularly toward the matrix of conductors, and it may extend through a plane of the surface, and even through the matrix of conductors. The electrically nonconductive region may comprise an aperture in the electrically conductive material, and may be in the general form of a rectangle. The rectangle may be square.

In a version of this aspect of the invention in which the antenna electromagnetic radiating element defining a feed point is in the general form of a rectangle, the feed point may comprises a conductive projection from a side of the rectangle in a plane orthogonal to the electrical conductor extending perpendicular to the surface. The conductive projection may project from a center of a side of the rectangle, and in the case that the electromagnetic radiating element defining a feed point is in the general form of a square, the feed point may comprise a conductive projection extending from a side of the square.

An antenna according to another aspect of the invention comprises a plurality of layers of solid dielectric material. Each of the layers defines first and second broad surfaces, first and second side edges, and an end edge. The plurality of layers is juxtaposed to define a stack of dielectric layers. Each interior layer of the stack of dielectric layers has its first broad surface adjacent the second broad surface of the next adjacent dielectric layer of the stack. Each interior dielectric layer of the stack has its second broad surface adjacent the first broad surface of the next adjacent dielectric layer. Each broad surface of a layer of the stack which is juxtaposed with an adjacent broad surface defines a juncture. The juxtaposed end edges of the stack of dielectric layers define an end surface. A ground plane is associated with the stack of dielectric layers. The ground plane comprises a layer of electrically conductive first material lying in each of the junctures at a location spaced by a predetermined distance from the end surface. The ground plane further comprises a plurality of electrically conductive through vias extending through and electrically interconnecting the layers of electrically conductive first material at locations spaced by at least the predetermined distance from the end surface. Thus, or whereby, the stack or body comprises both dielectric and electrically conductive materials. An electrically conductive electromagnetic radiating structure is attached to the end surface for transmitting/receiving electromagnetic radiation. A feed structure lies within the stack or body for coupling electromagnetic energy with the radiating structure.

In a particularly advantageous embodiment of this aspect of the invention, the electrically conductive materials of antenna comprise metallizations cofired with the dielectric layers to form a rigid solid.

In this aspect of the invention, the radiating structure of the antenna comprises at least an electrically conductive element affixed to the end surface of the stack or body, defining at least one feed point. In this arrangement, the feed structure comprises an electrically conductive second material other than the electrically conductive first material and electrically isolated therefrom. The electrically conductive second material lies in the plane of at least one of the junctures and is electrically connected to the feed point. The electrically conductive element of the radiating structure comprises a rectangular element, which may be square. The feed point may comprise a projection from a side of a rectangular or square element. In one embodiment, the electrically conductive electromagnetic radiating structure attached to the end surface for transmitting/receiving electromagnetic radiation comprises a nonconductive region, and the feed structure lying within the stack comprises a conductive excitation region lying between the electromagnetic radiating structure and the ground plane, and not in contact with either, for exciting the nonconductive region. A feed transmission conductor may be connected to the conductive excitation region and extend perpendicularly relative to the ground plane. The nonconductive region may comprise an aperture.

DESCRIPTION OF THE INVENTION

Figure 1:
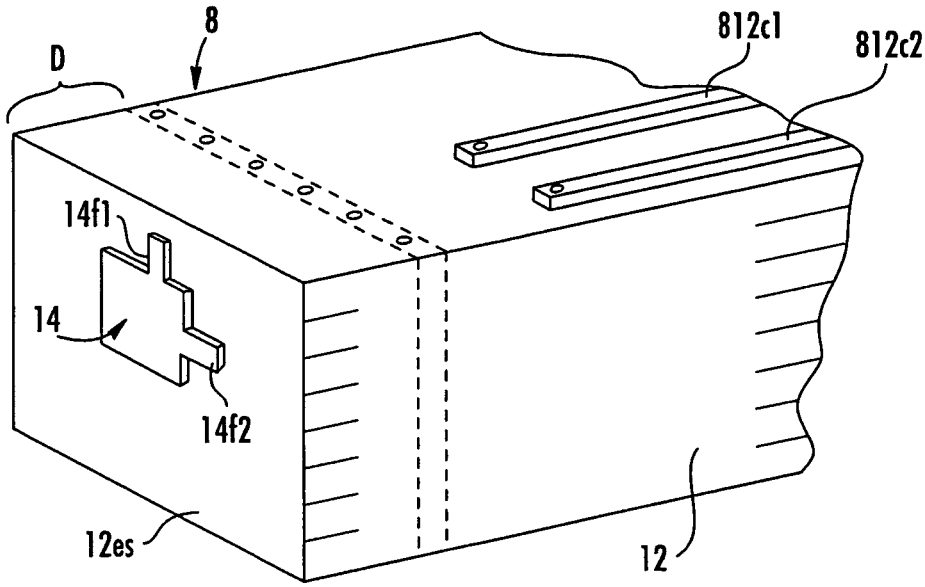
FIG. 1 is a simplified perspective or isometric view of a portion of an antenna structure according to an aspect of the invention.
Figure 2:
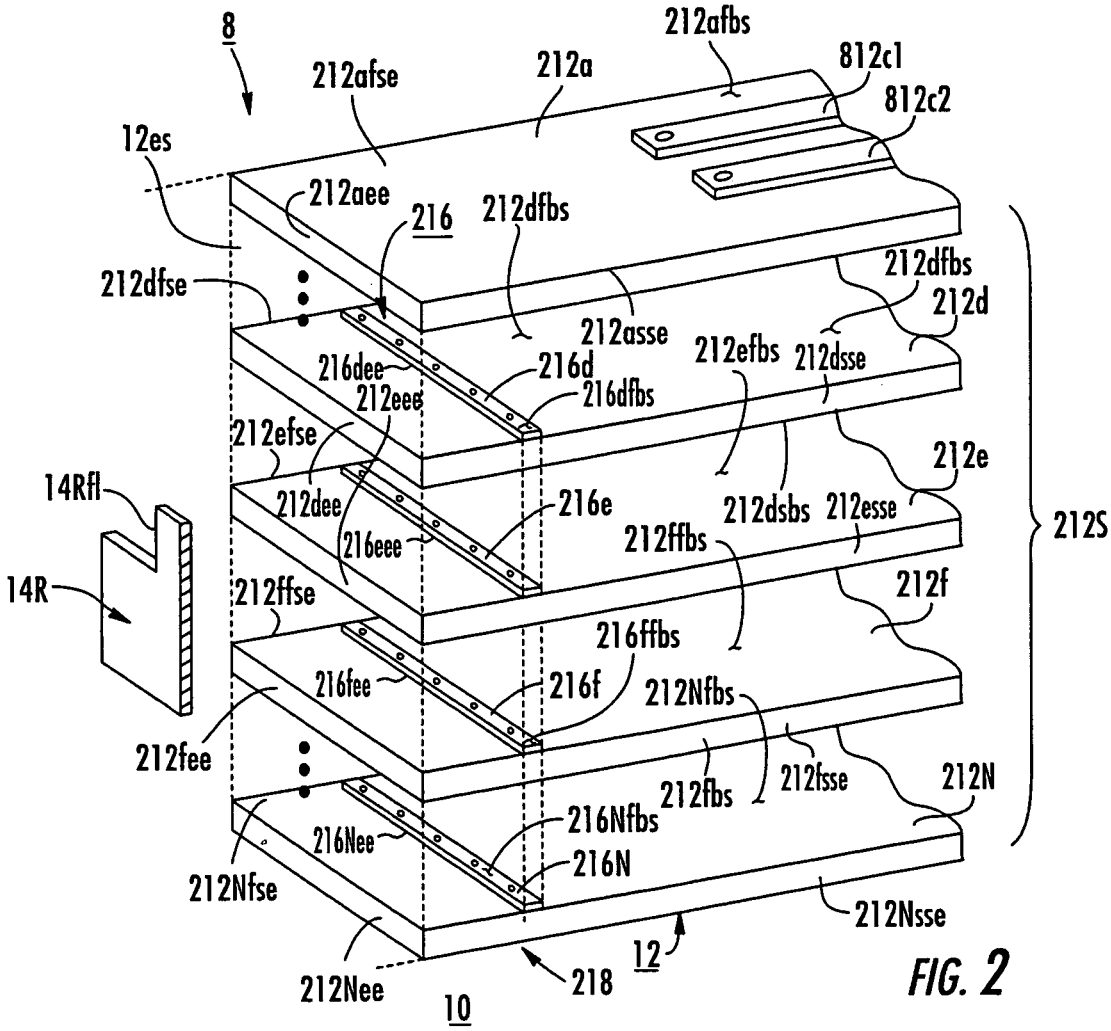
FIG. 2 is an exploded view of the portion of the antenna structure of FIG. 1 during a phase of the assembly or construction thereof.

In FIGS. 1 and 2, an antenna structure 10 according to an aspect of the invention includes a body 12 made in the form of a stack 212S of mostly dielectric layers, more visible in the exploded view of FIG. 2, and also includes an electrically conductive radiating portion 14.

In FIG. 2, body 12 can be seen to be made up as a stack 212 of juxtaposed planar layers 212*a*, . . . , 212*d*, 212*e*, 212*f*, . . . , 212N. While the term "planar" suggests zero thickness, all real things have finite dimensions. The thicknesses of the layers are selected depending upon the detail or fineness with which the interior structure is to be defined and the desired final dimensions of the antenna structure 10. In FIG. 2, the uppermost layer is layer 212*a*. Several representative interior layers are designated 212*d*, 212*e*, and 212*f*. The lowermost layer is designated 212N, where N represents the total number of layers.

Figure 3A:
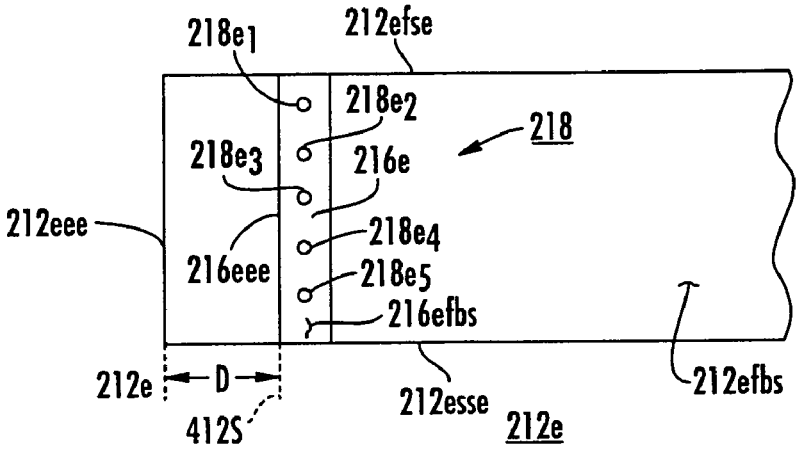
FIG. 3*a* is a plan view of a first broad side of a representative one of the interior layers of the structure of FIG. 1 or 2.
Figure 3B:
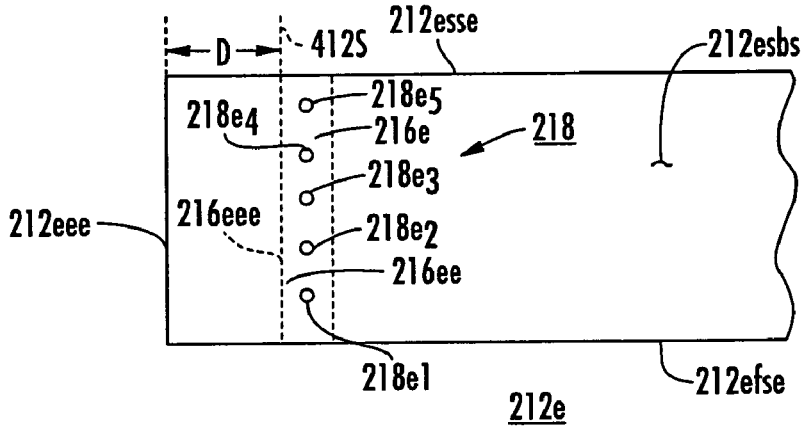
FIG. 3*b* is a plan view of the reverse broad side of the interior layer of FIG. 3*a*.

Referring now to FIG. 3*a*, representative interior layer 212*e* defines a first broad surface or side 212*efbs*. First broad surface 212*efbs* of dielectric layer 212*e* defines first and second mutually parallel side edges 212*efse* and 212*esse*, respectively. FIG. 3*b* represents the reverse side of interior layer 212*e*, and shows a second broad surface designated 212*esbs*, which is parallel with first broad surface 212*efbs*. An end edge of layer 212*e* is designated 212*eee* in both FIGS. 3*a* and 3*b*.

In FIG. 3*a*, a layer of electrically conductive material lying or affixed on the first broad surface 212*efbs* of dielectric layer 212*e* is designated 216*e*. Electrically conductive material 216*e* may be a metallization. Conductive material 216*e* may be in the form of a strip, as illustrated, or may extend over much of the second broad surface 212*efbs* on which it lies. A salient aspect of conductive material 216*e* is that it defines an edge, designated 216*eee*. As illustrated, edge 216*eee* is straight, and runs parallel to end edge 212*eee* of dielectric layer 212*e*, and at a distance therefrom which is a selected distance D. Thus, conductive material 216*e* is spaced away from end edge 212*eee*, and more generally the corresponding conductive materials 216*d*, 216*e*, 216*f*, . . . , 216N on the upper broad surfaces of dielectric layers 212*d*, 212*e*, 212*f*, . . . , 212N, respectively, are spaced away from an end surface defined by the end edges 212*dee*, 212*eee*, 212*fee*, . . . , 212N*ee*, respectively, of the juxtaposed layers 212*d*, 212*e*, 212*f*, . . . , 212N, respectively. This end surface is designated 12*es* in the partially exploded view of FIG. 4*a*.

Figure 3C:
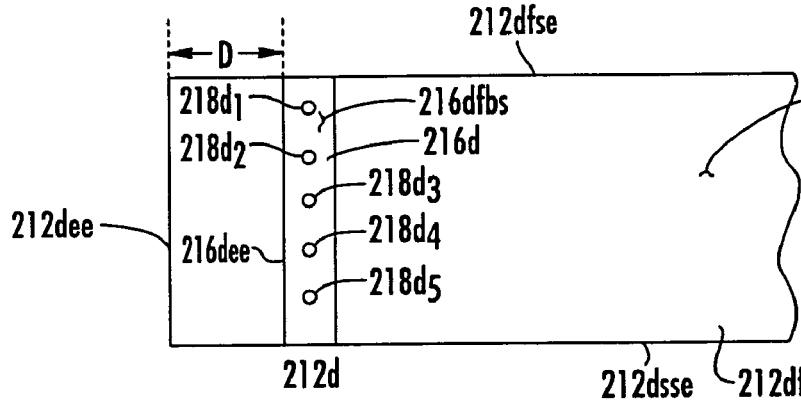
FIG. 3*c* is a plan view of a first broad side of an interior layer adjacent that of FIGS. 3*a* and 3*b*.
Figure 3D:
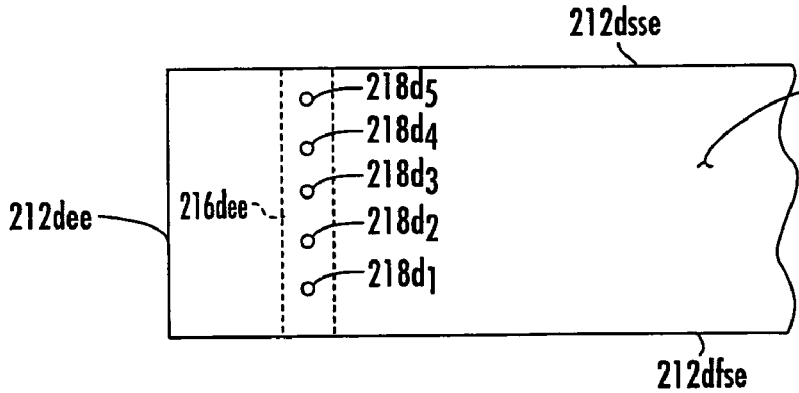
FIG. 3*d* is a plan view of the reverse broad side of the layer of FIG. 3*c;*

FIGS. 3*c* and 3*d* illustrate first and second broad sides 212*dfbs* and 212*dsbs*, respectively, of dielectric layer 212*d* of FIG. 2. As illustrated, interior dielectric layer 212*d* of FIGS. 3*c* and 3*d* is identical in structure to interior dielectric layer 212*e* of FIGS. 3*a* and 3*b*. More particularly, dielectric layer 212*d* defines first and second side edges 212*dfse* and 212*dsse*, respectively, and an end edge 212*dee*. In addition, dielectric layer 212*d* has an electrically conductive layer 216*d* lying on its first broad surface 212*dfbs* with an edge 216*dee* at a distance D from end edge 212*dee*. All of the other layers of dielectric of the structure of FIG. 2, except the uppermost exterior layer 212*a*, are identical to those illustrated in FIGS. 3*a*, 3*b*, 3*c*, and 3*d* insofar as the electrically conductive materials or metallization layers 216 are concerned. There may be other differences between and among the metallizations of the various layers as detailed hereinafter, and in general, there may be other conductive layers, or different configurations of the conductive layers, among the different layers.

Figure 4A:
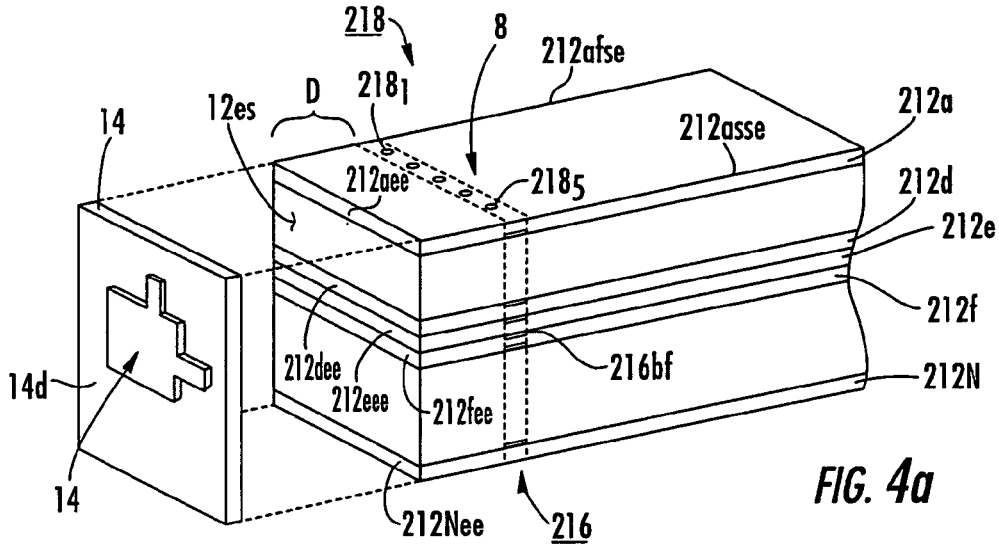
FIG. 4*a* is a partially exploded view of a portion of the antenna structure of FIG. 1 during a phase of construction different from that shown in FIG. 2.

When all the layers of dielectric material as illustrated in FIG. 2 are juxtaposed so as to form or define a solid body 12 as illustrated in FIG. 4*a*, with each of the interior layers . . . 212*d*, 212*e*, 212*f*, . . . of the juxtaposed structure having the configuration illustrated in FIGS. 3*a*, 3*b* and 3*c*, 3*d*, each electrically conductive material 216*d*, 216*e*, 216*f*, . . . , 216N of a set 216 lies on the first broad surface 212*dfbs*, 212*efbs*, 212*efbs*, . . . , 212N*fbs* of the associated layer 212*d*, 212*e*, 212*e*, . . . , 212N and at least the edges corresponding to 216*dee* and 216*cee* of FIGS. 3*c* and 3*a*, respectively, are in registry. More particularly, referring to FIG. 4*c*, the edges 216*dee*, 216*eee*, 216*fee*, . . . , 216N*ee* of electrically conductive materials 216*d*, 216*e*, 216*f*, . . . 216N, respectively, of grid ground plane 8, follow or define a plane surface illustrated in edge view as 412S. FIG. 4*c* also illustrates one of the electrically conductive through vias $\mathbf{218}_5$ which interconnects the various layers of electrically conductive materials 216*d*, 216*e*, 216*f*, . . . , 216N by means of sections 218$_5$*ab* connecting layer 216*a* to 216*b*, 218$_5$*bc* connecting layer 216*b* to 216*c*, . . . , 218$_5$*de* connecting layer 216*d* to 216*e*, and 218$_5$*ef* connecting layer 216*e* to 216*f*.

Figure 4B:
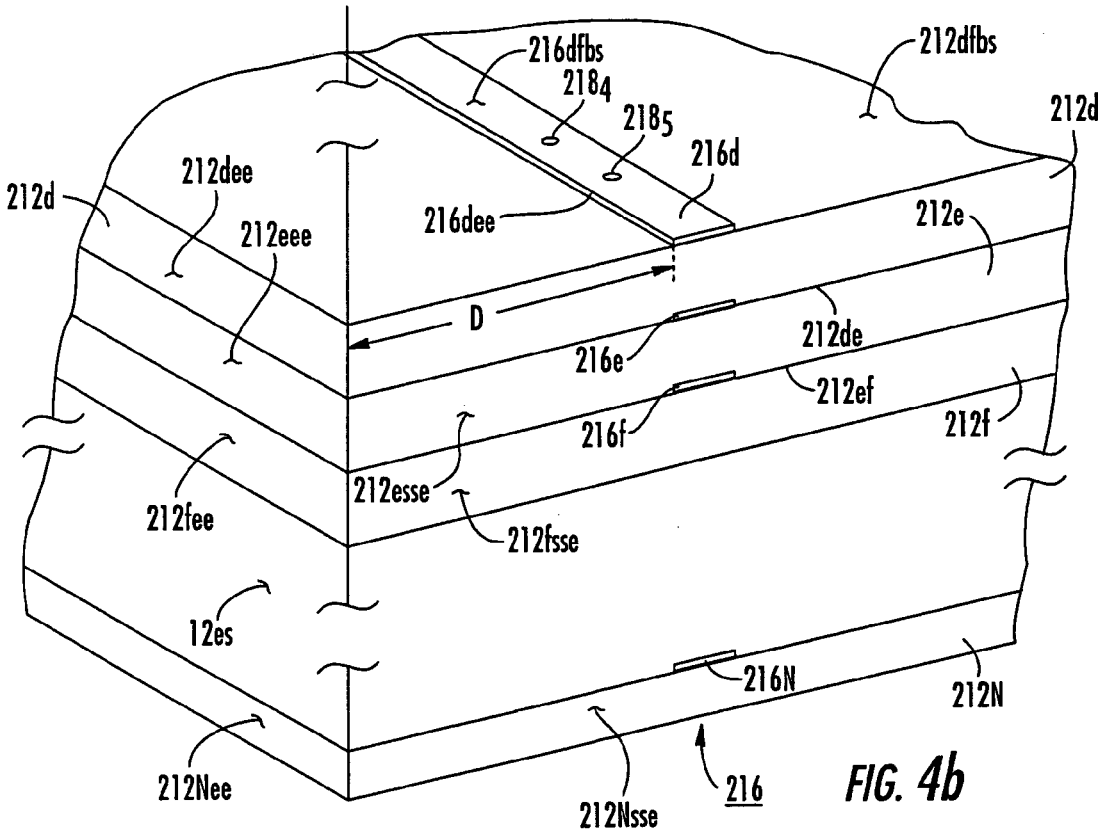
FIG. 4*b* is a detail thereof.
Figure 4C:
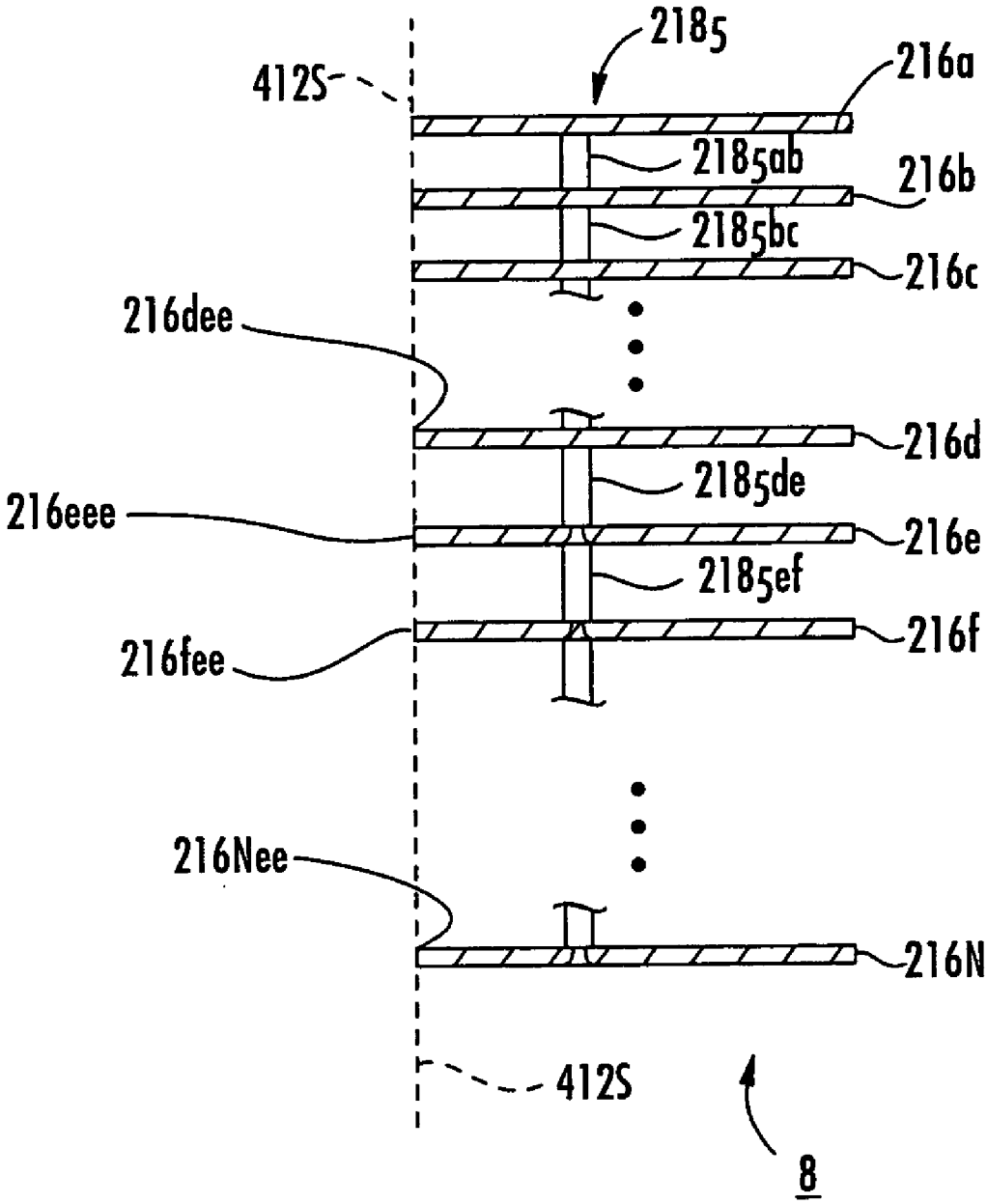
FIG. 4*c* is a conceptual side elevation view of a portion of a grid ground plane.

Each of the electrically conductive materials 216*d*, 216*e*, 216*f*, . . . , 216N of FIGS. 4*a* and 4*b* lies on the first broad surface 212*dfbs*, 212*efbs*, 212*efbs*, . . . , 212N*fbs* of the associated layer 212*d*, 212*e*, 212*e*, . . . , 212N, in the juncture or junction between the first broad surface of a given layer and the second broad surface of the next adjacent layer, as illustrated in FIG. 4*b*. In this context, a juncture or junction is the plane at which two adjacent layers meet. More particularly, only the edge of metallization 216*e* lying on the first broad surface 212*efbs* of dielectric layer 212*e* is seen in FIG. 4*b*, in a juncture or junction designated as 212*de*, and metallization 216*f* lying on the first broad surface 212*ffbs* of dielectric layer 212*f* is seen in edge view in FIG. 4*b*, in a juncture or junction designated as 212*ef*. In at least some embodiments of the invention, the layers of dielectric and electrically conductive material making up body 12 retain the layered morphology, but are made into a unitary structure in which the layers are not separable without destroying the structure.

According to an aspect of the invention, the ground plane 8 against which the radiating portion 14 of the antenna structure 10 of FIGS. 1, 2, and 4 works is composed, in part, of the various electrically conductive layers or materials 216*d*, 216*e*, 216*f*, . . . , 216N arranged as a grid. These conductors each lie in a plane which is orthogonal to the plane in which one would ordinarily expect to find a ground plane. In order to function as a single ground plane 8 rather than as a plurality of independent elements, electrically conductive elements extend between or among the various electrically conductive layers or materials 216*d*, 216*e*, 216*f*, . . . , 216N to electrically tie them into a single grid-like entity.

According to a further aspect of the invention, the various electrically conductive layers 216*d*, 216*e*, 216*f*, . . . , 216N of grid ground plane 8 of FIGS. 1, 2, and 4*a* are electrically tied together by a set 218 of a plurality of plated-through vias, represented in FIGS. 3*a*, 3*b*, 3*c*, and 3*d* by the designations 218*e*1, 218*e*2, 218*e*3, 218*e*4, and 218*e*5. In FIG. 4*a*, the through vias are designated 218$_1$, 218$_2$, 218$_3$, 218$_4$, and 218$_5$. These through vias are plated through with electrically conductive material, as for example a metallization, so as to interconnect each of the individual layers of electrically conductive material 216*d*, 216*e*, 216*f*, . . . , 216N with all the other layers. The set 218 of through vias 218$_1$, 218$_2$, 218$_3$, 218$_4$, and 218$_5$ defines a plane which, as represented in FIGS. 1, 2, and 4, lies parallel with the plane of the end surface 12*es*, and at a distance from the end surface which is at least equal to D. Those skilled in the art will recognize that, in addition to the illustrated set 218 of through vias lying in a single plane, through vias may be made at any plane at which the electrically conductive layers 216 exist, and such additional through electrical connections will tend to make the ground plane more robust in an electrical sense, meaning it will take on more of the characteristics of a solid conductive ground plane. Also, while only five through vias have been illustrated, those skilled in the art know that a greater or lesser number may be used, depending upon the dimensions of the ground planes, the operating frequency, the cost of additional through vias, and possibly other factors.

Figure 5:
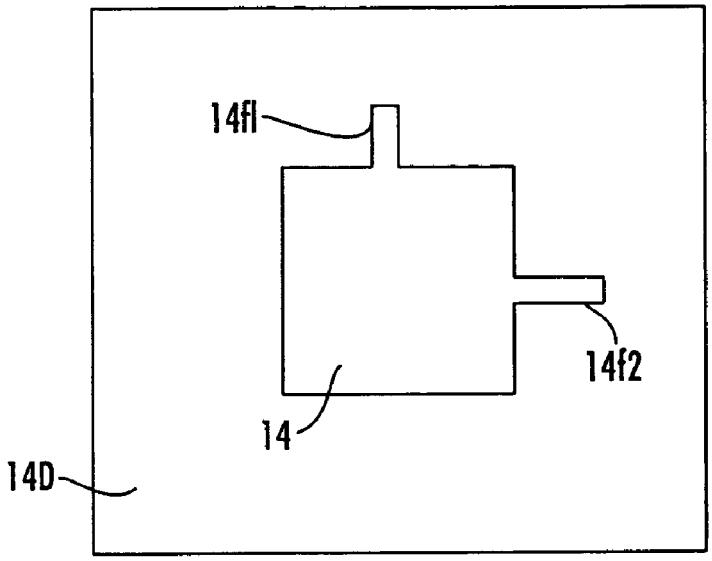
FIG. 5 is a plan view of a dielectric sheet bearing a conductive pattern for a radiating element.

In the arrangement of FIGS. 1, 2, and 4*a*, the radiating element is an electrically conductive element designated 14. As illustrated in FIG. 4*a*, conductive element 14 may be mounted on a separate dielectric sheet 14D for convenience in manufacturing. However mounted, conductive or radiating element 14 defines at least one feed point or electrode. Regardless of its form, radiating element 14 requires a feed. FIG. 5 is a plan view of the radiating element 14 of FIG. 4*a*, showing the radiating element as a rectangular, and more specifically square, patch antenna. A first electrically conductive feed 14*f*1 extends perpendicularly from the uppermost edge of patch 14 of FIG. 5, and a second feed 14*f*2 extends perpendicularly from the right-most edge. Those skilled in the art know that each feed point is capable of exciting the patch antenna in one of two mutually orthogonal linear polarization radiation modes. Excitation of the two feed points in phase quadrature can excite circular polarization radiation.

As illustrated in FIGS. 1, 2, and 4*a*, the radiating element 14 is affixed to the end surface 12*es* of the body 12. When so affixed, radiating element 14 is spaced by distance D from the grid ground plane 8 composed of mutually parallel conductive layers . . . , 216*d*, 216*e*, 216*f*, . . . , 216N of set 216. When appropriately fed with electromagnetic signal, radiating element 14 can radiate in either of two mutually orthogonal linear polarizations, in a slant linear polarization, or in circular polarization.

Figure 6:
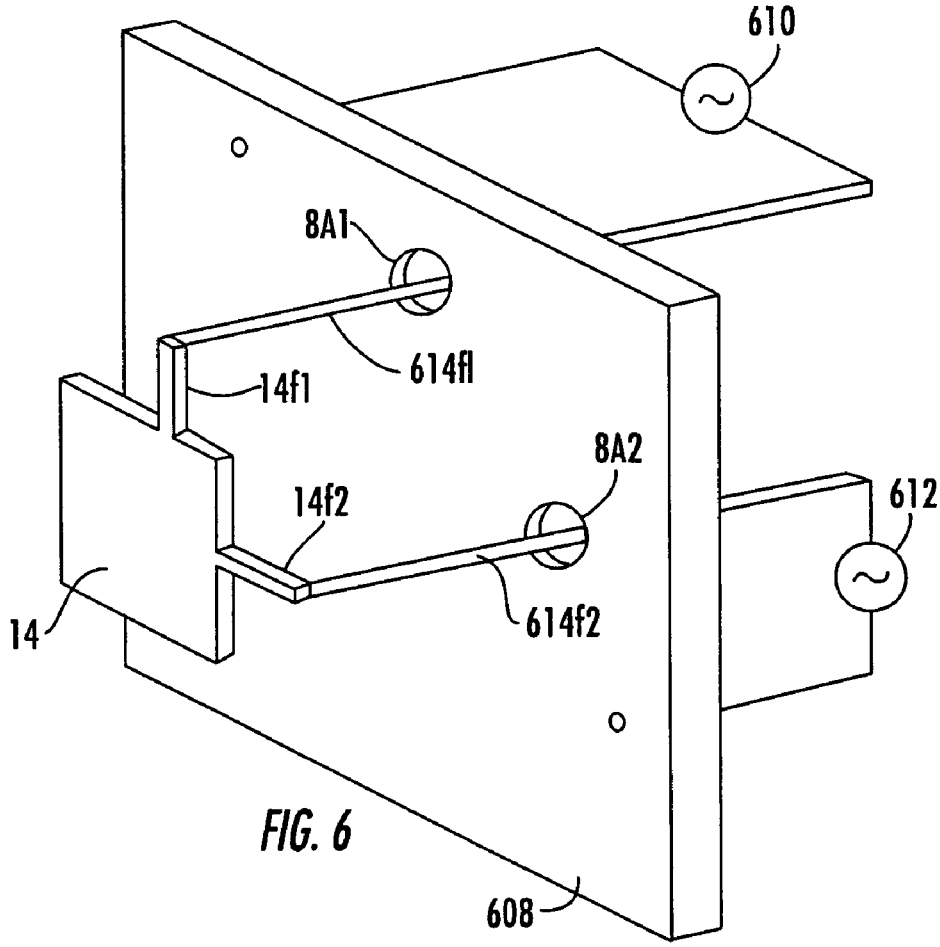
FIG. 6 is a simplified, conceptual perspective or isometric view of the a feed arrangement for the radiating element of FIG. 5.

FIG. 6 is a simplified perspective or isometric view of an appropriate feed arrangement for a patch antenna such as 14 of FIG. 1, 2, or 4*a*. In FIG. 6, the ground plane 608 is illustrated, solely for explanatory purposes, as being a simple planar structure, rather than the more complex grid structure 8 of interconnected layers of conductive material described in FIG. 1, 2, or 4*a*. In the arrangement of FIG. 6, a first signal from a source represented by a symbol 610 is applied to a conductor 614*f*1, which passes through an aperture 8A1 in ground plane 608 and makes connection with feed structure 14*f*1 of radiating element 14. The other terminal of source 610 is connected to the ground plane 608. The combination of source 610 connecting to the ground plane 608 and to the first feed point of radiating element 14 is sufficient to excite one linear polarization of radiation. Similarly, a second signal from a source represented by a symbol 612 is applied to a conductor 614*f*2, which passes through an aperture 8A2 in ground plane 608 and makes connection with feed structure 14*f*2 of radiating element 14. The other terminal of source 612 is connected to the ground plane 608. The combination of source 612 connecting to the ground plane and to the second feed point of radiating element 14 is sufficient to excite a second linear polarization of radiation, and together with the first source, gives rise to the possibility of slant linear polarization and circular polarization. Those skilled in the art know that such slant and circular polarizations require particular phase and or amplitude relationships between the signals of sources 610 and 612.

Figure 7:
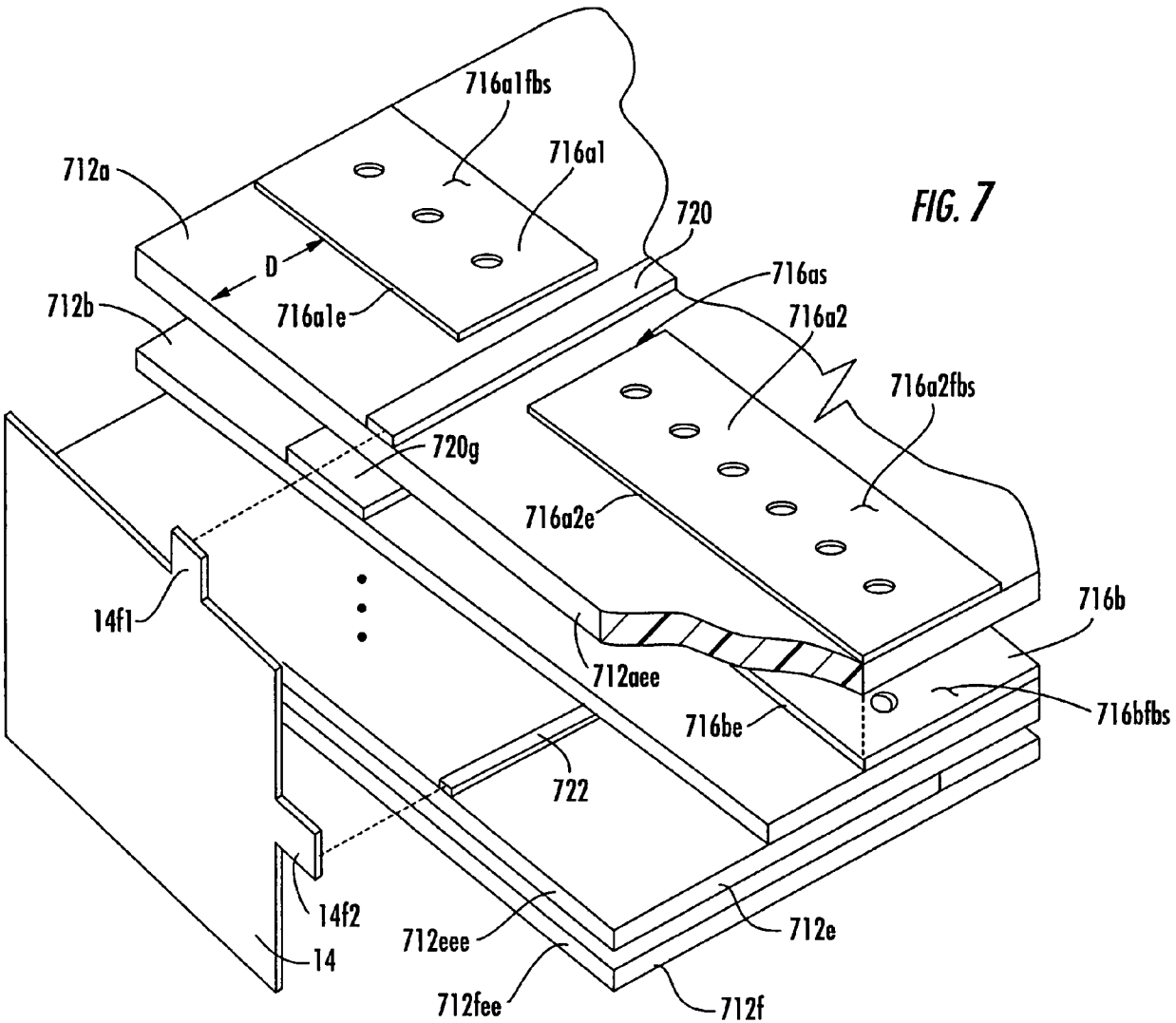
FIG. 7 illustrates how the feed arrangement of FIG. 6 can be implemented in a structure such as that of FIG. 1, 2, or 4*a*.

FIG. 7 is a simplified perspective or isometric view of a conceptual arrangement which illustrates how the feeding of the feed points of radiating element 14 is accomplished. In FIG. 7, radiating element 14 is illustrated as being exploded away from end edges 712*aee*, 712*bee*, . . . , 712*eee*, and 712*fee* of the interior layers 712*a*, 712*b*, . . . , 712*e*, and 712*f*, respectively. As illustrated, an electrically conductive strip 720 extends from end edge 712*aee* for a distance of D toward the edge 716*a*1*e* and 716*a*2*e* of two noncontinuous portions 716*a*1 and 712*a*2 of the ground plane of layer 712*a*. A nonconductive "slot" 716*a*S extends between the two portions 712*a*1 and 712*a*2 of the ground plane of layer 712*a*. The strip electrical conductor 720 can extend through slot 716*a*S without contacting the ground. Of course, a through via cannot make contact with strip conductor 720, so it must be routed in locations in which through vias will not be formed, or must be isolated in some manner from the via. The strip conductor 720 electrically interconnects the feed point 14*f*1 of radiating element 14 with locations within the body 12 of the module 10 of FIG. 1.

As known to those skilled in the art, strip conductor 720 can coact with the ground plane segments 716*a*1 and 716*a*2 to define a "coplanar waveguide," and or can coact with a conductive ground plane underlying layer 712*a* (that is, with the ground plane 716*b* and extension 720*g* on layer 712*b*, for example) to define a "microstrip" transmission-line structure. Should there be ground planes on either side of the strip conductor 720, it could coact with both to define a "stripline" transmission line. Each of these types of transmission line is well known, and each has their own characteristics. The selection of the type of transmission line depends upon the exact structure, and what is to be accomplished. Different types of transmission line structure may be used within the same structure. It is very desirable to provide "buried grounds" similar to 720*g* of FIG. 7 for each strip conductor for which controlled transmission-line properties are desired. Thus, strip conductors 812*c*1 and 812*c*2 of FIG. 2 may desirably be associated with buried grounds lying parallel with the dielectric layers of stack 212S, and any interior strip conductors used as transmission lines could also be associated with buried grounds, even though not specifically mentioned herein.

In a manner similar to that described for feeding feed point 14*f*1, a strip conductor 722 extends over the surface of dielectric layer 712*e* of FIG. 7. Strip conductor 722 is arranged with ground plane portions (not illustrated in FIG. 7) associated with layer 712*e* to extend from radiating element 14 feed 14*f*2 to locations within the structure of body 12.

In the arrangement of FIG. 2 or 4*a*, the radiating element 14 may be made or applied to end face 12*es* by deposition of electrically conductive material, as for example by masking and vapor or liquid deposition. When properly registered, the feed points of the electrically conductive radiating element 14 should contact the feed conductors corresponding to 720 and or 722 of FIG. 7 for making an electrical connection therewith.

Figure 8A:
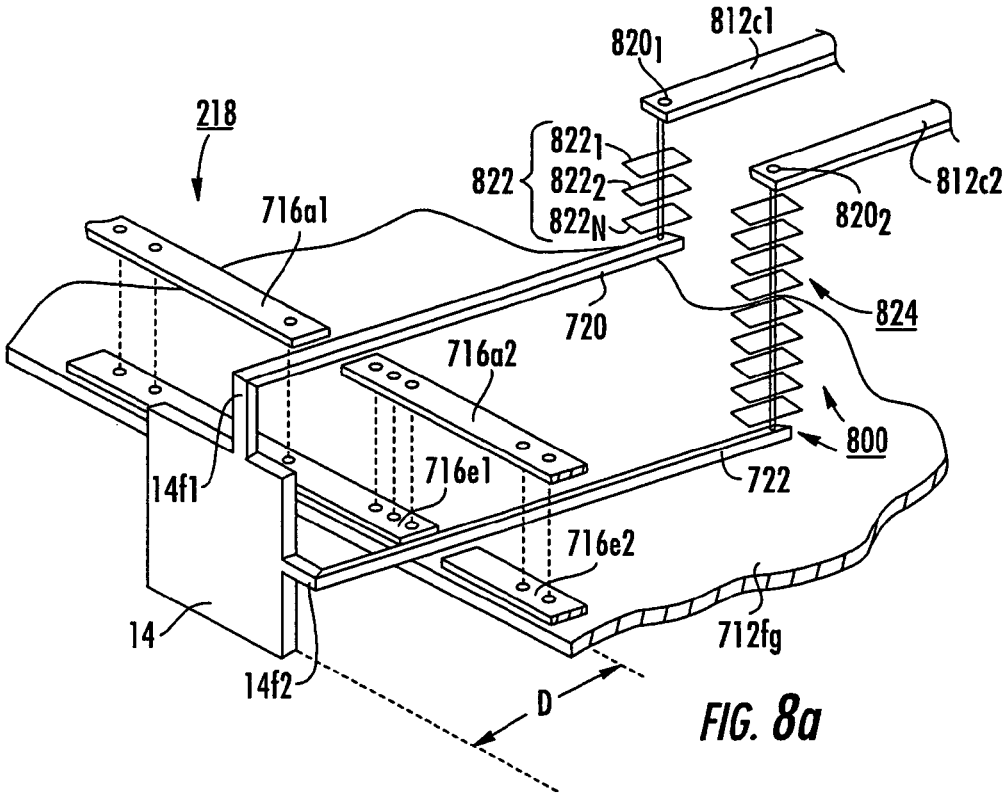
FIG. 8*a* is a simplified, conceptual perspective or isometric view of a feed arrangement including the arrangement of FIG. 7.
Figure 8B:
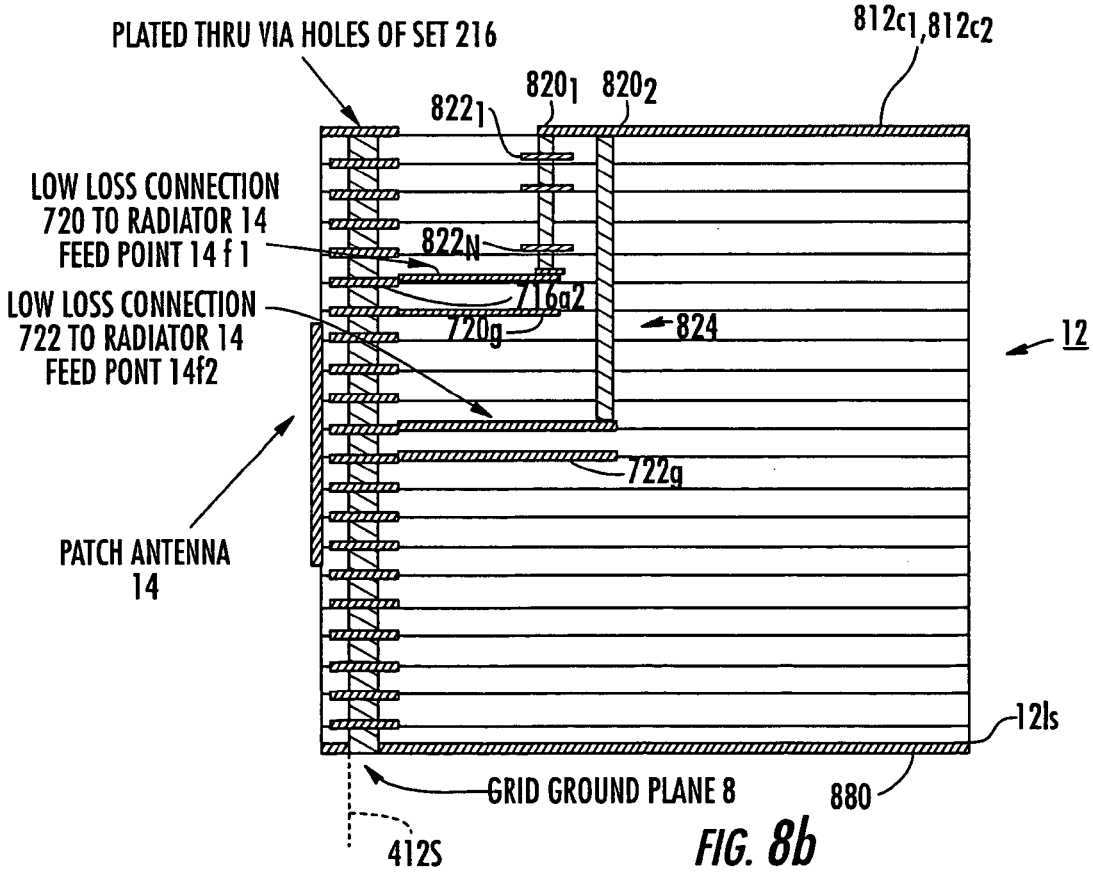
FIG. 8*b* is a conceptual side cross-sectional view thereof.
Figure 8C:
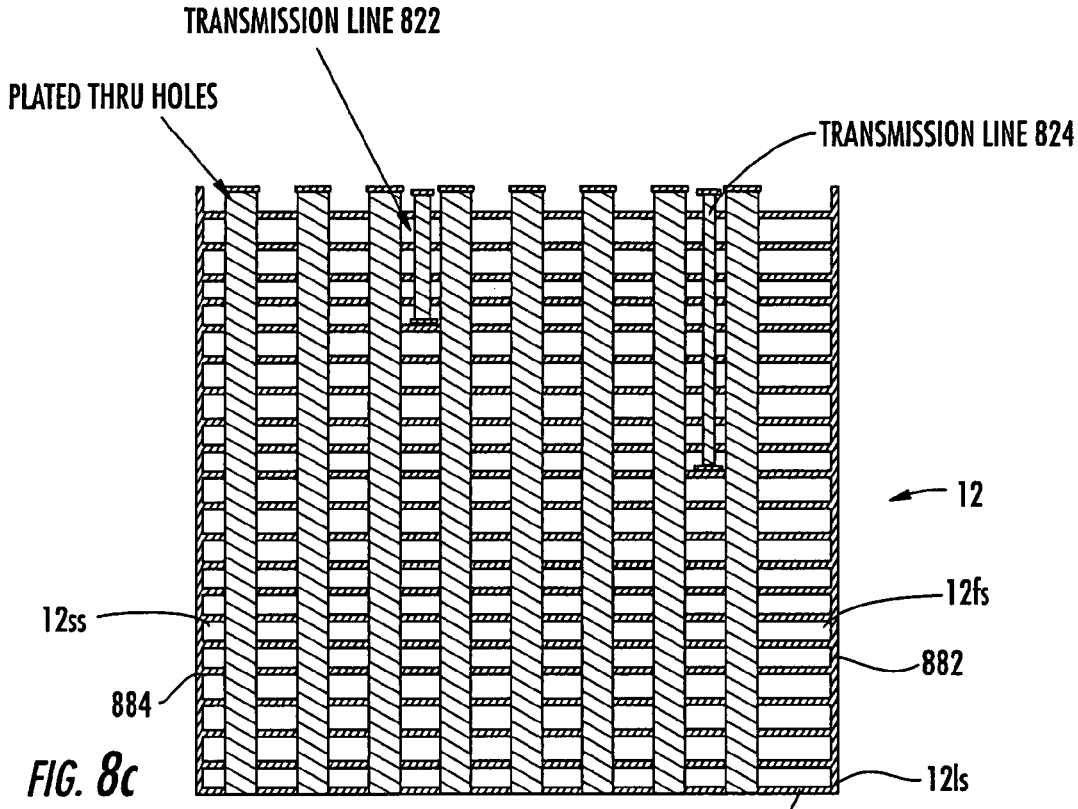
FIG. 8*c* is a conceptual end cross-sectional view thereof.

FIG. 8*a* is a simplified, partially exploded, perspective or isometric view of a radiating element 14 with feed points 14*f*1 and 14*f*2, visualizing salient ones of the interior electrical conductors lying within body 12 of FIG. 1. FIG. 8*b* is a side cross-section of the structure of corresponding to that of FIG. 8*a*, and FIG. 8*c* is an end cross-sectional view taken at the grid ground plane 8. In FIGS. 8*a*, 8*b*, and 8*c*, elements corresponding to those of other FIGURES are designated by like reference numerals. FIGS. 8*a*, 8*b*, and 8*c* generally describe feed structures 800 lying within the body 12 of the structure 12. In FIGS. 8*a*, 8*b*, and 8*c*, ground plane portions 716*a*1 and 716*a*2 are separated to allow passage of strip conductor 720 for feeding feed point 14*f*1, as described in conjunction with FIG. 7. Similarly, ground plane portions 716*e*1 and 716*e*2 are separated to allow passage of strip conductor 722 feeding the second feed point 14*f*2 of radiating element 14. A set of through vias, designated 218, interconnects the ground plane conductor portions of those layers which overlie each other, as by electrically interconnecting conductor portion 716*a*1 with conductor portion 716*e*1, interconnecting conductor portion 716*e*1 with conductor portion 716*a*2, and conductor portion 716*a*2 with 716*e*2. These interconnections tend to tie the conductors into a continuously conductive ground (grid) structure 8 with a planar surface lying at distance D from the radiating element 14.

FIG. 8*b* illustrates the application of buried ground planes to strip conductors. More particularly, FIG. 8*b* illustrates buried ground plane 720*g* lying under strip conductor 720 and another buried ground plane 722*g* lying under strip conductor 722.

The feed strip conductors 720, 722 of FIGS. 8*a*, 8*b*, and 8*d* are isolated from the grid ground plane 8. This is accomplished by providing the equivalent of an opening or aperture in the grid ground plane at the location at which the strip conductor penetrates the grid ground plane. The aperture may be a natural opening in the grid, or the aperture may be located where a through via or other grid element would otherwise occur. The source conductors for feeding the feed points of the radiating element 14 of FIG. 8*a* are source conductors 812C1 and 812C2, visible in FIG. 1, lying on the first or uppermost broad surface 212*afbs* of FIG. 2. In general, each of these source conductors continues in the form of a plurality of through vias extending "vertically" through the body structure 12 until they reach a layer which is level with a feed point of radiating element 14, and then proceed laterally through slots in the various ground planes to make contact with the feed points. More particularly, strip conductor 812C1 of FIGS. 8*a*, 8*b*, and 8*c* ends at a through via $\mathbf{820}_1$, and strip conductor 812C2 ends at a through via $\mathbf{820}_2$. Through via $\mathbf{820}_1$, makes contact with a conductive pad $\mathbf{822}_1$, and in succession with additional conductive pads, one in each layer, some of which pads are designated $\mathbf{822}_2$, . . . $\mathbf{822}_N$, making up a vertical transmission line designated generally as 822. The last conductor which is contacted by vertical transmission line 822 is conductor 720 of FIG. 8*a*. Similarly, a through via $\mathbf{820}_2$ at the end of source conductor 812C2 in FIG. 8*a* carries the signal by way of a plurality of conductive pads, one in each layer, which are designated together as a vertical transmission line 824 in FIG. 8*a*. The lowermost conductor which through via transmission line 824 contacts is conductor 722, which itself connects with feed point 14*f*2. Thus, there is a continuous path extending from source conductor 812C1, through vertical transmission line 822 to strip conductor 720, and to the antenna feed point 14*f*1. Similarly, there is a continuous path extending from source conductor 812C2 to feed point 14*f*2 by way of vertical transmission line 824 and strip conductor 722.

In FIGS. 8*a*, 8*b*, and 8*c*, an electrically conductive layer of material designated 880 lies under the lowermost layer of body 12 and attached to the lower surface 12*ls* of the structure 12, to aid in providing shielding of the structure, and to provide a terminus for the lowermost through vias 218 of the grid ground plane 8. Also, an electrically conductive layer 882 lies on or is attached to a side 12*fs* of the structure 12 as seen in FIG. 8*c*, and a further layer 884 lies on or is attached to a second side 12*ss*. These three outermost conductive layers make contact with one another at the edges. Conductive layers 882 and 884 also make contact with the ends of the conductors of set 216 of conductors.

Figure 9A:
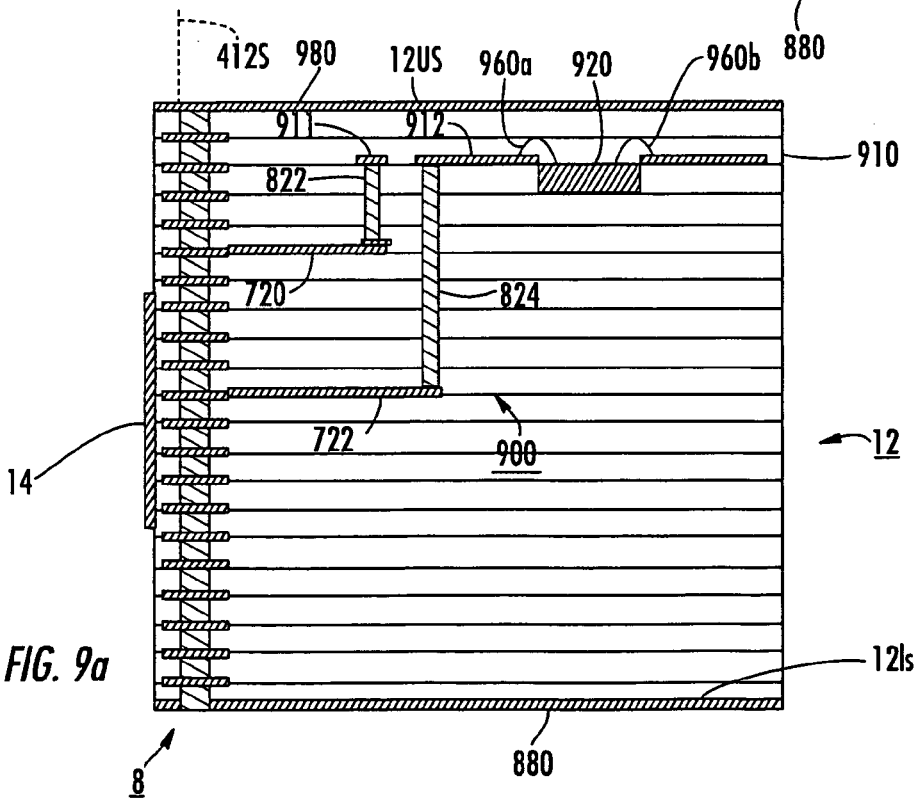
FIG. 9*a* is a simplified side cross-section of another embodiment of the invention.
Figure 9B:
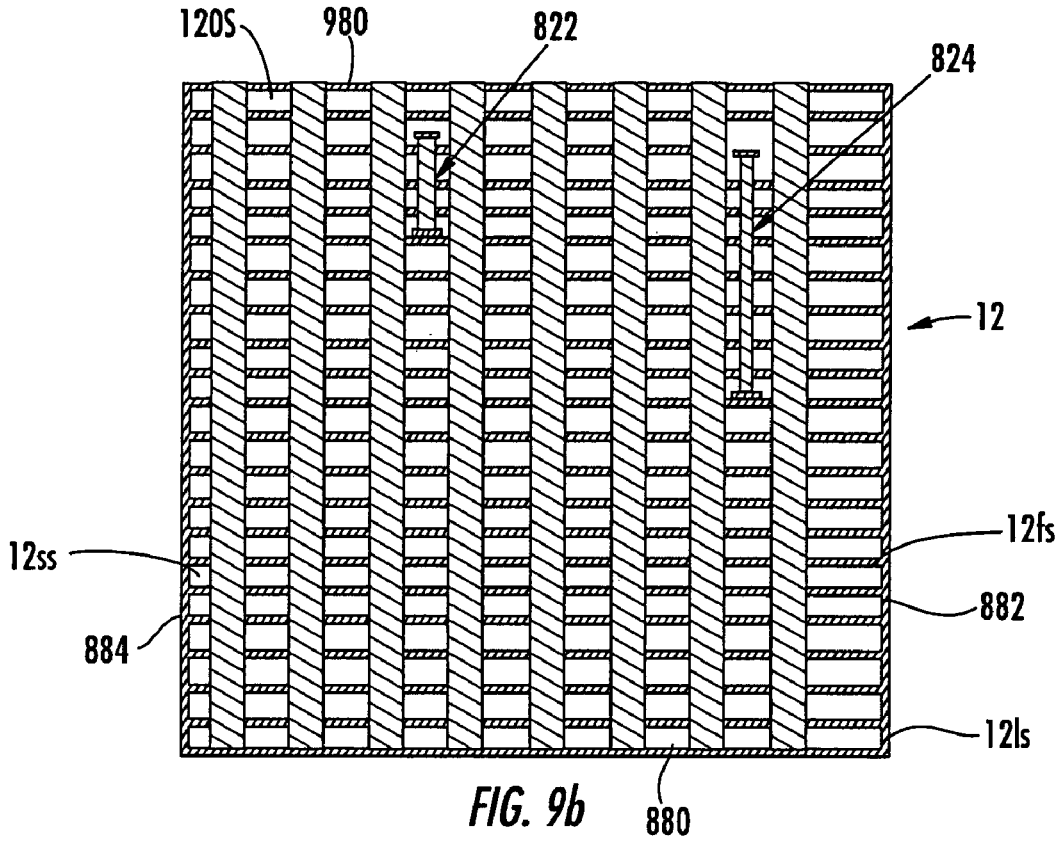
FIG. 9*b* is a cross-section taken through the grid ground plane of the structure of FIG. 9*a*, showing an interior electronic device or module.

FIGS. 9*a* and 9*b* are similar to FIGS. 8B and 8C, but differ in details, to illustrate another embodiment of the invention. In FIGS. 9*a* and 9*b*, elements corresponding to those of FIGS. 8*b* and 8*c* are designated by like reference numerals. FIGS. 9*a* and 9*b* illustrate in a general manner feed structures 900 for the radiating element 14, where the feed structures lie within the body of structure 12. In FIGS. 9*a* and 9*b*, the vertical transmission lines 822 and 824 do not reach the uppermost surface of the structure 12, but instead terminate at an interior level designated 910. At level 910, the uppermost ends of vertical transmission lines 820 and 822 transition to horizontally disposed or extending conductors, as in the case of FIGS. 8*a*, 8*b*, and 8*c*. These horizontally disposed conductors are designated 911 and 912, respectively. Both horizontally disposed conductors 911 and 912 connect their respective vertical transmission lines 822 and 824, respectively, to an electrical element interior to the body of structure 12. For example, in FIG. 9*a*, electrical strip conductor 912 connects to the uppermost level of vertical transmission line 824, and extends (by way of bond wires 960*a*, 960*b*) to a module designated 920, which may be, for example, an electrical switch for connecting and disconnecting signal to or from the antenna, or module 920 may be an amplifier, or generally any device or devices which it may be advantageous to integrate into the structure 12. This arrangement may be particularly useful for making microwave/millimeterwave modules for use with an array antenna, as the entire module, including electronic elements, may be fabricated in or on the same structure as the antenna element for that particular module. Of course, many more modules may be provided than the single illustrated module, and they may be connectable to individual vertical transmission lines, or interconnectable to either vertical transmission line, so as to feed a dual-polarization antenna with either linear polarization. In this context, a "module" may be a single electronic element, such as a resistor, capacitor, inductor, transistor, or the like, or it may be an actual modular from the structure 12 and incorporated therein during fabrication.

FIGS. 9*a* and 9*b* illustrate another facet of the invention. It will be noted that, in addition to an electrically conductive lower surface 880 and electrically conductive side surfaces 882 and 884, as in FIGS. 8*b* and 8*c*, the structure of FIGS. 9*a* and 9*b* also has a layer 980 of electrically conductive material lying on, or affixed to, the uppermost surface 12*us* of the structure 12. Electrically conductive layer 980 makes electrical contact with side conductive materials 882 and 884, which in turn contact lower layer 880, thus establishing an electrically conductive shielding "box" surrounding the interior conductors of the structure. Such a shielding structure is known to reduce the likelihood of interference with or from an external source, and it also helps to make the grounds more stable or "solid."

Figure 10A:
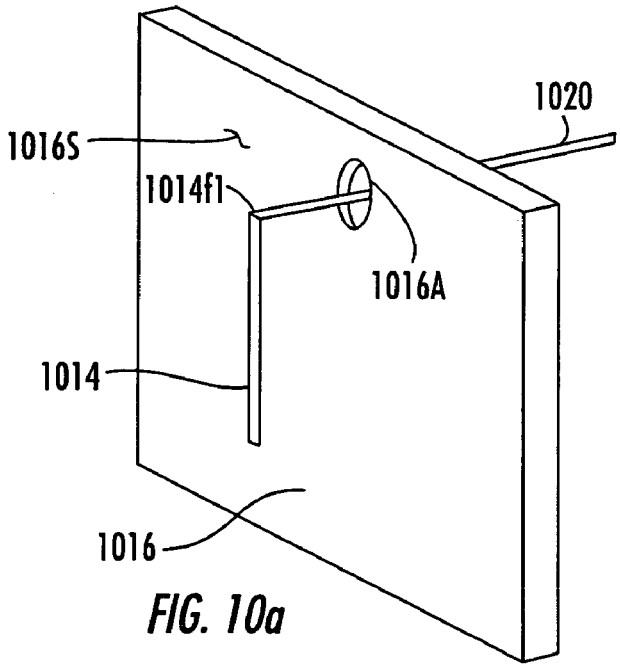
FIG. 10*a* is a perspective or isometric view of another form of radiating element.
Figure 10B:
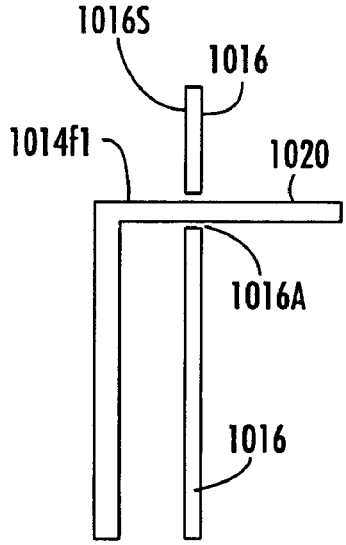
FIG. 10*b* is a cross-sectional view thereof.

FIGS. 10*a* and 10*b* illustrate a radiating element 1014 having a feed point 1014*f*1. Radiating element 1014 lies before, and spaced from, a grid ground plane 1016, which is illustrated in simplified form, but which is in the form of a plurality of mutually parallel planar electrically conductive sheets, having registered edges which together define the surface 1016*s* of ground plane 1016, all as described in conjunction with FIGS. 2, 3*a*, 3*b*, 3*c*, 3*d*, 4*a*, 4*b*, 6, and 7. An electrical feed conductor 1020 extends through an aperture 1016A in ground plane 1016 to contact feed point 1014*f*1. Those skilled in the art know that a radiating element having the configuration illustrated in FIGS. 10*a* and 10*b* will tend to radiate a single linear polarization.

Figure 11A:
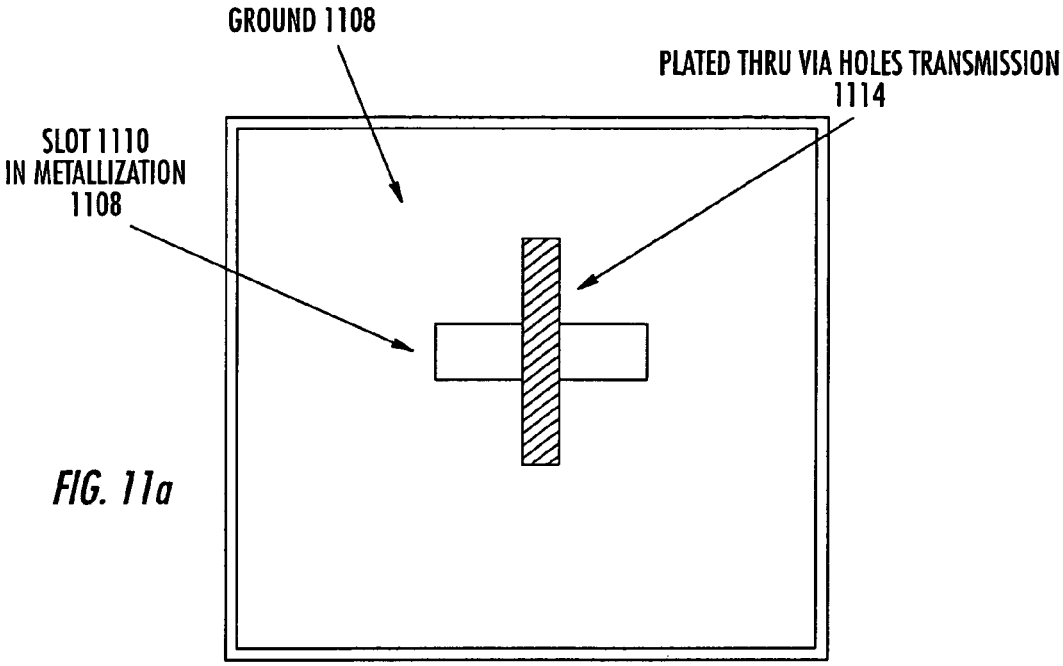
FIG. 11*a* is a simplified radiating-end view of another embodiment of the invention, showing a slot radiating element.
Figure 11B:
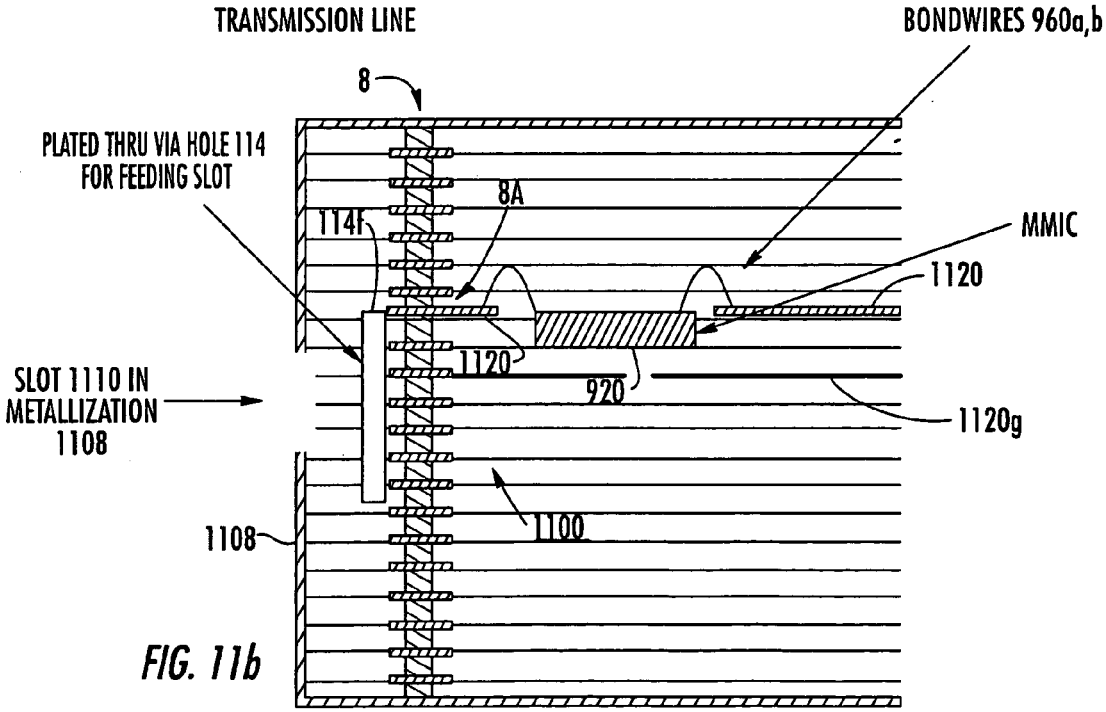
FIG. 11*b* is a simplified side cross-section of the structure of FIG. 11*a*, showing a gridded ground plane and a method for feeding the slot, and also showing an internal electronic module or device.

FIG. 11*a* is a simplified view of the radiating end 1122*es* of an antenna according to another embodiment of the invention. FIG. 11*b* is a corresponding side elevation cross-section. FIGS. 11*a* and 11*b* illustrate generally feed structures 1100 for, in conjunction with a gridded ground plane 8, feeding a slot radiating element 1110. In FIG. 11*b*, the grid ground plane is designated as 8, and in FIGS. 11*a* and 11*b* a radiating-end conductive material or metallization is designated generally as 1108. An opening or slot in radiating-end metallization 1108 is designated 1110. Those skilled in the art know that a slot in a conductor or ground plane such as ground plane 1108 will radiate in a manner which is similar to the radiation of a conductive material of the same size and shape as the slot, so the dimensions and morphology of the slot affect the radiation in known manner. A slot can be fed at particular locations, much like a discrete conductive element, but must be fed with a "balanced" feed, which may require another element, namely an unbalanced-to-balanced transmission converter or "balun." In order to avoid the need for a balun, the slot can also be excited by a noncontacting feed. In FIGS. 11*a* and 11*b*, the signal feed for slot 1110 is a "vertically" disposed electrically conductive element, similar to conductive element 1014 of FIGS. 10*a* and 10*b*, but located within the structure 12 at a location lying between the slot 1110 and the gridded ground plane 8. In FIGS. 11*a* and 11*b*, this vertically disposed conductive element is designated 1114, and is made up of a plurality of through vias (not separately illustrated). The vertically disposed conductive element 1114 itself has a feed point 1114*f*, which is fed by a transmission line strip conductor 1120. Transmission line strip conductor 1120 extends in a non-contacting manner through an aperture 8A in gridded ground plane 8. As in the case of the embodiment of FIGS. 9*a* and 9*b*, an electronic device or module, which may be a monolithic microwave integrated circuit (MMIC) 920, is connected by means of bond wires 960*a, b*, or any other means, to transmission line 1120. Also, as described above, a ground plane 1120*g* may be associated with the strip conductor 1120.

Those skilled in the art know that the shape of a patch antenna may be other than square. It may be rectangular, round, oval, or polyhedral. The feed points of a patch antenna may be spaced away from the principal portions of the patch, as illustrated in FIG. 1, or may lie on a periphery of the principal portion. While the buried ground planes have been described as lying under the associated strip conductors, they may lie above, or they may be placed both above or below. In the case of coplanar ground planes, they may lie adjacent the strip conductor. Coplanar grounds may be used in conjunction with grounds lying in different planes from the strip conductor. If the manufacturing technology permits, the conductive pads, such as conductive pads $\mathbf{822}_1$, to $\mathbf{822}_N$, can be made very small, only the plated-through vias (and side metallizations if provided) provide the connections among the layers.

An antenna (10) according to an aspect of the invention comprises a plurality or set (216) of planar conductors ( . . . 216*d*, 216*e*, 216*f*, . . . , 216N), each of which planar conductors ( . . . , 216*d*, 216*e*, 216*f*, . . . , 216N) defines a broad side (216*dfbs*, 216*efbs*, 216*ffbs*, . . . , 216N*fbs*) and an edge ( . . . , 216*dee*, 216*eee*, 216*fee*, . . . , 216N*ee*). The plurality of planar conductors ( . . . 216*d*, 216*e*, 216*f*, . . . , 216N) is placed in an array with the broad side (216*dfbs*, 216*efbs*, 216*ffbs*, . . . , 216N*fbs*) of each planar conductor parallel with the broad side of other planar conductors ( . . . , 216*d*, 216*e*, 216*f*, . . . , 216N) of the plurality, and with the edges ( . . . , 216*dee*, 216*eee*, 216*fee*, . . . , 216N*ee*) of the plurality of planar conductors ( . . . 216*d*, 216*e*, 216*f*, . . . , 216N) in registry with corresponding edges of others of the plurality (216). The registered edges ( . . . , 216*dee*, 216*eee*, 216*fee*, . . . , 216N*ee*) of the planar conductors ( . . . , 216*d*, 216*e*, 216*f*, . . . , 216N) define a discontinuous surface (412S). A set or plurality (218) of plated-through vias (such as 218*e*1, 218*e*2, 218*e*3, 218*e*4, and 218*e*5) interconnects the plurality of mutually parallel planar conductors ( . . . , 216*d*, 216*e*, 216*f*, . . . , 216N) to thereby define a matrix of conductors or ground (8). An electromagnetic radiating element (14) for transmitting/ receiving electromagnetic waves is located adjacent the surface (412S) but spaced therefrom, and oriented with an electrical conductor lying parallel with the surface (412S).

In an advantageous embodiment of this aspect of the invention, the electromagnetic radiating element (14) defines a feed point (14*f*1), and the antenna (10) further comprises an electrical conductor (614*f*1) connected to the feed point (14*f*1). The electrical conductor (614*f*1) extends perpendicular to the surface (412S) and at least into a plane defined by the matrix of conductors (8), electrically isolated from the matrix of conductors (8).

In another advantageous embodiment of this aspect of the invention, the electromagnetic radiating element (14) for transmitting/receiving electromagnetic waves comprises an electrically conductive material (1108) lying in a plane parallel to the surface (412S). The electrically conductive material (1108) is electrically isolated from the matrix of conductors (8). The electrically conductive material (1108) defines an electrically nonconductive region (1110), the dimensions of which region (1110) are selected for transmitting/receiving over a predetermined electromagnetic frequency range. In this other advantageous embodiment, the antenna (10) further comprises an aperture-exciting electrically conductive element (1114) lying between the electrically nonconductive region (1110) and the matrix of conductors (8). A feed conductor (1120) is in contact with the aperture-exciting electrically conductive element (1114) and extends from the aperture-exciting electrically conductive element (1114) perpendicularly toward the matrix of conductors (8), and it may extend through a plane of the surface (412S), and even through the matrix of conductors (8). The electrically nonconductive region may comprise an aperture (1110) in the electrically conductive material (1108), and may be in the general form of a rectangle. The rectangle may be square.

In a version of this aspect of the invention in which the antenna (10) electromagnetic radiating element (14) defining a feed point (14*f*1) is in the general form of a rectangle, the feed point (14*f*1) may comprises a conductive projection from a side of the rectangle in a plane orthogonal to the electrical conductor (614*f*1; 720) extending perpendicular to the surface (412S). The conductive projection may project from a center of a side of the rectangle, and in the case that the electromagnetic radiating element (14) defining a feed point (14*f*1) is in the general form of a square, the feed point (14*f*1) may comprise a conductive projection extending from a side of the square.

An antenna (10) according to another aspect of the invention comprises a plurality (212S) of layers of solid dielectric material (212*a*, . . . , 212*d*, 212*e*, 212*f*, . . . , 212N). Each of the layers defines first (212*afbs*, . . . , 212*dfbs*, 212*efbs*, 212*ffbs*, . . . , 212N*fbs*) and second broad surfaces (such as 212*dsbs* and 212*esbs*), first (212*afse*, . . . , 212*dfse*, 212*efse*, 212*ffse*, . . . , 212N*fse*) and second (212*asse*, . . . , 212*dsse*, 212*esse*, 212*fsse*, . . . , 212N*sse*) side edges, and an end edge (212*aee*, . . . , 212*dee*, 212*eee*, 212*fee*, . . . , 212N*ee*). The plurality of layers (212*a*, . . . , 212*d*, 212*e*, 212*f*, . . . , 212N) is juxtaposed to define a stack (212S) of dielectric layers. Each interior layer (212*dfbs*, 212*efbs*, 212*ffbs*, for example) of the stack (212S) of dielectric layers has its first broad surface (212*afbs*, . . . , 212*dfbs*, 212*efbs*, 212*ffbs*, . . . , 212N*fbs*) adjacent the second broad surface (212*asse*, . . . , 212*dsse*, 212*esse*, 212*fsse*, . . . , 212N*sse*) of the next adjacent dielectric layer of the stack. Each interior dielectric layer (212*dfbs*, 212*efbs*, 212*ffbs*, for example) of the stack (212S) has its second broad surface (212*asse*, . . . , 212*dsse*, 212*esse*, 212*fsse*, . . . , 212N*sse*) adjacent the first broad surface (212*afbs*, . . . , 212*dfbs*, 212*efbs*, 212*ffbs*, . . . , 212N*fbs*) of the next adjacent dielectric layer. Each broad surface (212*afbs*, . . . , 212*dfbs*, 212*efbs*, 212*ffbs*, . . . , 212N*fbs*; 212*asse*, . . . , 212*dsse*, 212*esse*, 212*fsse*, . . . , 212N*sse*) of a layer of the stack (212S) which is juxtaposed with an adjacent broad surface defines a juncture (212*de*, 212*ef*, for example). The juxtaposed end edges (212*aee*, . . . , 212*dee*, 212*eee*, 212*fee*, . . . , 212N*ee*) of the stack (212S) of dielectric layers define an end surface (12*es*). A ground plane (8) is associated with the stack (212S) of dielectric layers. The ground plane comprises a layer of electrically conductive first material (216*d*, 216*e*, 216*f*, . . . , 216N) lying in each of the junctures (212*de*, 212*ef*, for example) at a location spaced by a predetermined distance (D) from the end surface (12*es*). The ground plane (8) further comprises a plurality (218) of electrically conductive through vias ($\mathbf{218}_1$, . . . , $\mathbf{218}_5$) extending through and electrically interconnecting the layers of electrically conductive first material (216*d*, 216*e*, 216*f*, . . . , 216N) at locations spaced by at least the predetermined distance (D) from the end surface (12*es*). Thus, or whereby, the stack or body (12) comprises both dielectric and electrically conductive materials. An electrically conductive electromagnetic radiating structure (14, 1108) is attached to the end surface (12*es*) for transmitting/receiving electromagnetic radiation. A feed (720, 722, 822, 824, 1114, 1120) structure lies within the stack or body (12) for coupling electromagnetic energy with the radiating structure (14).

In a particularly advantageous embodiment of this aspect of the invention, the electrically conductive materials of antenna (10) comprise metallizations cofired with the dielectric layers to form a rigid solid.

In this aspect of the invention, the radiating structure (14) of the antenna (10) comprises at least an electrically conductive element (14; 1108) affixed to the end surface (12*es*) of the stack or body (12), defining at least one feed point (14*f*1). In this arrangement, the feed structure comprises an electrically conductive second material (720; 1120) other than the electrically conductive first material (14, 1108) and electrically isolated therefrom. The electrically conductive second material (720; 1120) lies in the plane of at least one of the junctures (212*de* or 212*ef*, for example) and is electrically connected to the feed point (14*f*1; 1114*f*). The electrically conductive element (14, 1108) of the radiating structure (14) comprises a rectangular element, which may be square. The feed point (14*f*1) may comprise a projection from a side of a rectangular or square element. In one embodiment, the electrically conductive electromagnetic radiating structure (1108) attached to the end surface (12*es*) for transmitting/receiving electromagnetic radiation comprises a nonconductive region (1110), and the feed structure lying within the stack comprises a conductive excitation region (1114) lying between the electromagnetic radiating structure (14) and the ground plane (8), and not in contact with either, for exciting the nonconductive region (1110). A feed transmission conductor (1120) may be connected to the conductive excitation region (1114) and extend perpendicularly relative to the ground plane (8). The nonconductive region (1110) may comprise an aperture.

What is claimed is:

1. An antenna, comprising:

a plurality of planar conductors, each of said planar conductors defining a broad side and an edge, said plurality of planar conductors being placed in an array with said broad side of each planar conductor parallel with the broad side of other planar conductors of said plurality, and with said edges of said plurality of planar conductors in registry with corresponding edges of others of the plurality to thereby define a discontinuous surface;

a plurality of plated-through vias interconnecting said plurality of mutually parallel planar conductors to thereby define a matrix of conductors; and an electromagnetic radiating element for transmitting/receiving electromagnetic waves, said radiating element being located adjacent said surface but spaced therefrom, and comprising an electrical conductor lying generally parallel with said surface.

2. An antenna according to claim 1, wherein said electromagnetic radiating element defines a feed point, said antenna further comprising:

an electrical conductor connected to said feed point, said electrical conductor extending perpendicular to said surface and at least into a plane defined by said matrix of conductors, electrically isolated from said matrix of conductors.

3. An antenna according to claim 2, wherein said electromagnetic radiating element is in the general form of a rectangle, and said feed point comprises a conductive projection from a side of said rectangle, said conductive projection lying in a plane orthogonal to said electrical conductor extending perpendicular to said surface.

4. An antenna according to claim 2, wherein said electromagnetic radiating element is in the general form of a square, and said feed point comprises a conductive projection extending from a side of said square.

5. An antenna according to claim 1, wherein said electromagnetic radiating element for transmitting/receiving electromagnetic waves comprises an electrically conductive material lying in a plane parallel to said surface, said electrically conductive material being electrically isolated from said matrix of conductors, said electrically conductive material defining an electrically nonconductive region, the dimensions of which region are selected for transmitting/receiving over a predetermined electromagnetic frequency range.

6. An antenna according to claim 5, further comprising:

an aperture-exciting electrically conductive element lying between said electrically nonconductive region and said matrix of conductors; and a feed conductor in contact with said aperture-exciting electrically conductive element and extending from said aperture-exciting electrically conductive element perpendicularly toward said matrix of conductors.

7. An antenna according to claim 6, wherein said feed conductor extends through a plane of said surface.

8. An antenna according to claim 7, wherein said feed conductor extends through said matrix of conductors.

9. An antenna according to claim 5, wherein said electrically nonconductive region comprises an aperture in said electrically conductive material.

10. An antenna according to claim 9, wherein said aperture of said electrically conductive material is in the general form of a rectangle.

11. An antenna according to claim 10, wherein said rectangle is a square.

12. An antenna according to claim 3, wherein said conductive projection projects from a center of a side of said rectangle.

13. An antenna, comprising:

a plurality of layers of solid dielectric material, each of said layers defining first and second broad surfaces, first and second side edges, and an end edge, said plurality of layers being juxtaposed to define a stack of dielectric layers, each interior layer of said stack of dielectric layers having said first broad surface adjacent said second broad surface of the next adjacent dielectric layer of said stack, and each interior dielectric layer of said stack having said second broad surface adjacent said first broad surface of the next adjacent dielectric layer, each broad surface of a layer of said stack which is juxtaposed with an adjacent broad surface defining a juncture, said juxtaposed end edges of said stack of dielectric layers defining an end surface;

a ground plane associated with said stack of dielectric layers, said ground plane comprising a layer of electrically conductive first material lying in each of said junctures at a location spaced by a predetermined distance from said end surface;

said ground plane further comprising a plurality of electrically conductive through vias extending through and electrically interconnecting said layers of electrically conductive first material at locations spaced by at least said predetermined distance from said end surface, whereby said stack comprises both dielectric and electrically conductive materials;

an electrically conductive electromagnetic radiating structure attached to said end surface for transmitting/receiving electromagnetic radiation; and a feed structure lying within said stack for transferring electromagnetic energy with said radiating structure.

14. An antenna according to claim 13, wherein said electrically conductive materials comprise metallizations cofired with said dielectric layers to form a rigid solid.

15. An antenna according to claim 13, wherein said radiating structure comprises at least;

an electrically conductive element affixed to said end surface of said stack and defining at least one feed point; and said feed structure comprises an electrically conductive second material other than said electrically conductive first material and electrically isolated therefrom, said electrically conductive second material lying in the plane of at least one of said junctures and being electrically connected to said feed point.

16. An antenna according to claim 15, wherein said electrically conductive element of said radiating structure comprises a rectangular element.

17. An antenna according to claim 16, wherein said rectangular element is square.

18. An antenna according to claim 17, wherein said feed point comprises a projection from a side of said square element.

19. An antenna according to claim 16, wherein said feed point comprises a projection from a side of said rectangular element.

20. An antenna according to claim 13, wherein said electrically conductive electromagnetic radiating structure attached to said end surface for transmitting/receiving electromagnetic radiation comprises a nonconductive region: and said feed structure lying within said stack comprises a conductive excitation region lying between said electromagnetic radiating structure and said ground plane, and not in contact with either, for exciting said nonconductive region.

21. An antenna according to claim 20, wherein said nonconductive region of said electrically conductive electromagnetic radiating structure comprises an aperture.

22. An antenna according to claim 20, further comprising a feed transmission conductor connected to said conductive excitation region, said feed transmission conductor extending from said conductive excitation region perpendicularly toward said ground plane.

* * * * *